US005404863A

United States Patent [19]

Poor

[11] Patent Number: 5,404,863

[45] Date of Patent: Apr. 11, 1995

[54] GAS-POWERED, SINGLE-SHOT GUN WITH TIP-UP BARREL FOR LOADING

[76] Inventor: Keith A. Poor, 2003 Craig Cir., Rogers, Ark. 72756

[21] Appl. No.: 1,023

[22] Filed: Jan. 6, 1993

[51] Int. Cl.[6] ..... F41B 11/00

[52] U.S. Cl. ..... 124/74; 124/83; 124/56

[58] Field of Search ..... 124/73–76, 124/71, 83, 56; 89/164, 160; 42/44, 40, 36, 12, 8

[56] References Cited

U.S. PATENT DOCUMENTS

| | | | |
|---|---|---|---|
| 36,571 | 9/1862 | Moses | 42/40 |
| 572,290 | 12/1896 | Clement | 42/40 |
| 1,059,405 | 4/1913 | Sprague | 42/8 |
| 1,165,256 | 12/1915 | Hill | 44/44 |
| 1,183,644 | 5/1916 | Hill | 124/75 |
| 2,150,288 | 3/1939 | Moller . | |
| 3,229,400 | 1/1966 | Del Pozo | 42/36 |
| 3,233,601 | 6/1962 | Walther . | |
| 3,379,188 | 4/1986 | Walther . | |
| 4,367,723 | 1/1983 | Resuggan . | |
| 4,422,433 | 12/1983 | Milliman . | |
| 4,774,929 | 10/1988 | Milliman . | |
| 4,883,042 | 11/1989 | Wackrow . | |
| 5,160,795 | 11/1992 | Milliman . | |
| 5,165,383 | 11/1924 | Ebert et al. . | |

*Primary Examiner*—Randolph A. Reese
*Assistant Examiner*—Anthony Knight
*Attorney, Agent, or Firm*—Hovey, Williams, Timmons & Collins

[57] ABSTRACT

A detent assembly at the breech of a gun having a single-shot, tip-up barrel normally holds the barrel in a closed, firing position, yet permits it to be tipped up for loading purposes upon the application of sufficient upward manual force. The detent securely interlocks the barrel with the valve body closely adjacent to the point of gas transfer from the valve body into the barrel so as to minimize misalignment of the barrel and the valve body due to tolerance buildup and manufacturing inaccuracies. Sealing surfaces on the spring loaded arms of the detent assembly situated on opposite lateral sides of the barrel also serve to cover the gap between the end of the valve body and the barrel when the detent is closed so as to inhibit the escape of gas during a firing action and eliminate the need for elastomeric sealing O-rings. Cooperating cam structures on the breech end of the barrel and the jaws of the detent assembly cause the retaining jaws to be sufficiently opened and closed as to clear the barrel during its opening and closing action.

23 Claims, 4 Drawing Sheets

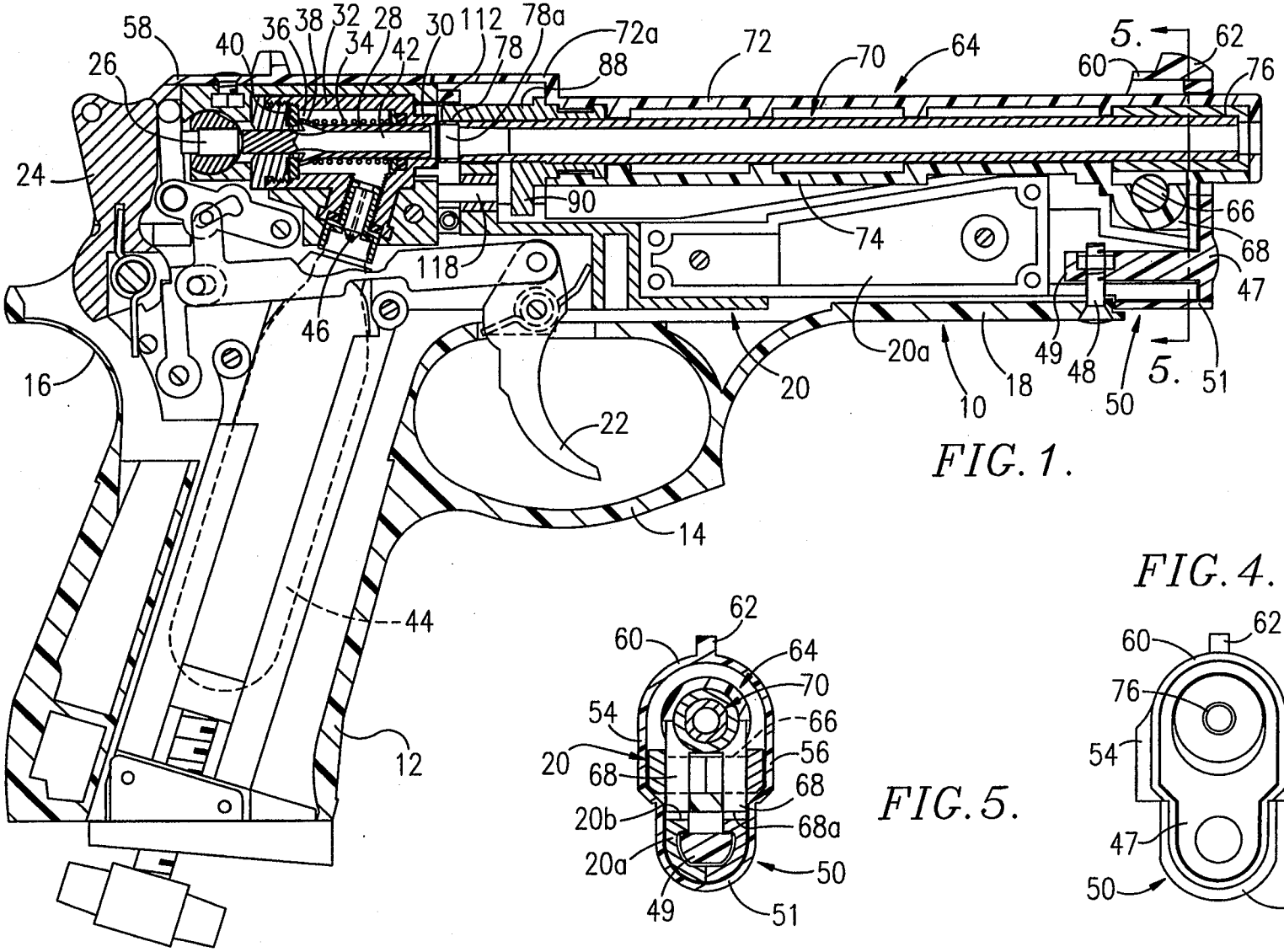
FIG. 1.
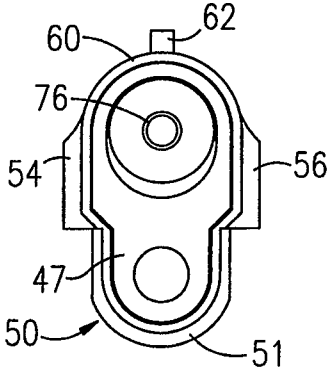
FIG. 4.
FIG. 5.

GAS-POWERED, SINGLE-SHOT GUN WITH TIP-UP BARREL FOR LOADING

TECHNICAL FIELD

The present invention relates to the field of gas-powered guns and, more particularly, to single-shot guns of the type in which the breech end of the barrel may be tipped up for loading and cleaning purposes. More specifically, it relates to a unique detent assembly which normally holds the barrel in its firing position precisely aligned with the gas outlet of the valve body yet releases the barrel for tip-up upon the application of enough manual force to overpower the retaining spring of the detent assembly.

BACKGROUND

Gas-powered guns, particularly pistols, have often incorporated barrels that unlatch and tip up as part of their design so as to facilitate loading and cleaning. However, that feature necessarily creates a potential trouble-spot because the otherwise continuous gas passage between the source of gas supply and the barrel now has a point of interruption at the interface between the barrel and the valve body that must be adequately sealed when the barrel is closed so that gas does not escape during the firing action. Furthermore, if the barrel is not returned to the exactly proper position before firing, the accuracy of the gun will be sacrificed.

SUMMARY OF THE PRESENT INVENTION

Accordingly, one important object of the present invention is to provide a new detent assembly which is capable of more accurate and precise alignment of the barrel and gas outlet in the firing position than may have heretofore been available, yet which does not encumber quick and easy opening and closing of the barrel. In addition, it is an important object of the present invention to provide a detent assembly which allows the elimination of elastomeric seals without significant sacrifice of the ability to prevent gas escape during the firing action.

These and other important objects of the present invention are obtained in the present invention by providing a detent assembly which applies the holding force to the barrel in the immediate vicinity of the critical gas transfer point from the valve body to the barrel. In other words, the breech end of the barrel is anchored, secured or attached to the valve body itself when in the firing position so that the forces needed to maintain the two relatively movable parts in perfect alignment with one another are applied at the very point where they are needed the most, thus minimizing the potential for magnifying or building up the misalignment error that is promoted in other constructions where the physical connection between the two parts is remote from the gas transfer point. By having parts of the detent also comprise sealing surfaces which wrap around and cover the clearance gap between the end of the barrel and the valve body, the detent can also serve as a means of preventing gas escape in its own right, in lieu of elastomeric O-rings and similar type seals.

The detent assembly of the present invention is located at the breech of the gun and utilizes a pair of clam shell-like, spring-loaded rocker arms that clasp hold of the end of the valve body and the breech end of the barrel to releasably retain the barrel in its firing or closed position. Sealing surfaces on the arms cover up the clearance gap between the barrel and the valve body to prevent gas escape. Cooperating cam surfaces on the arms and the barrel cause the arms to spread apart and release the barrel as it is forced open by the user. Other cam surfaces on the arms and the barrel cause the arms to progressively spread apart and admit the barrel as it is returned to its firing position. The action of the detent and the barrel is smooth and clean, allowing the barrel to be snapped open and closed in a manner that feels smooth and secure.

BRIEF DESCRIPTION OF THE DRAWINGS

FIG. 1 is a longitudinal cross sectional view through a pistol incorporating a detent assembly and tip-up barrel in accordance with the present invention, the barrel being illustrated in its closed or firing position;

FIG. 4 is a fragmentary, front elevational view of the muzzle end of the gun;

FIG. 5 is a fragmentary transverse cross sectional view of the gun taken substantially along line 5-5 of FIG. 1;

DETAILED DESCRIPTION

Figure 2:
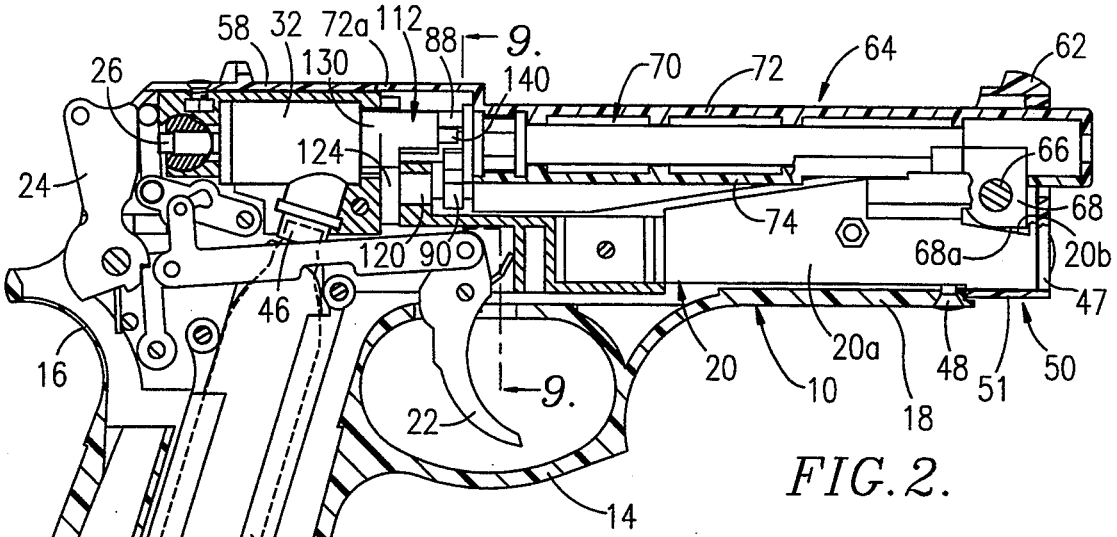
FIG. 2 is a similar cross sectional view of the gun but with internal components shown in elevation to illustrate other details of construction.

The gun chosen for purposes of illustration is a pistol, but it is to be understood that the principles of the present invention are not limited to a hand gun and could, instead, be utilized in conjunction with a rifle, if desired. Furthermore, although the particular gun herein disclosed is designed to be powered by a $CO_2$ gas cartridge and will be described as such for the sake of illustrating a preferred embodiment of the invention, it is to be understood that the principles of the present invention are equally applicable to guns which utilize compressed air instead of $CO_2$. As used herein, the term "gas-powered" will be used in a generic sense to include compressed air, $CO_2$, or any other pressurized gas. In addition, it is to be understood that many details of construction and operation of the gun disclosed herein are well known to those skilled in the art and will not, therefore, be elaborated upon hereinafter.

The gun has a mainframe 10 which includes, among other things, a handle portion 12, a trigger guard area 14, a hammer area 16, and a fore-and-aft barrel area 18. The barrel area 18, as well as the hammer area 16 above the handle 12 and the trigger guard 14, is generally trough-shaped in configuration, being open along its entire upper extent from front to rear, for the purpose of receiving internal operating components of the gun. In this respect, a subassembly unit 20 containing most of the operating mechanism of the gun is supported within the frame 10 as shown perhaps best in FIG. 3 in which the barrel is raised. Among other things, the subassembly unit 20 includes a trigger 22 that operates a hammer 24 to actuate a firing pin 26 when the hammer 24 is released. The firing pin 26 actuates the tubular valve stem 28 that is slidably mounted within the outlet boss 30 of a valve body 32. A coil spring 34 encircling the stem 28 within a gas storage compartment 36 in the body 32 yieldably urges the stem 28 leftwardly viewing FIGS. 1, 2 and 3 so as to sealingly engage a valve skirt 38 against a seat 40 at the left end of the valve body 32. When the skirt 38 is unseated from the seal 40 momentarily by the firing pin 26 impacting the stem 28, an interior, axial passage 42 within the stem 28 instantaneously communicates with gas in the compartment 36 so as to provide a gas burst for firing a projectile from the gun. Gas is supplied to the compartment 36 by a $CO_2$ cartridge or the like 44 housed within the handle portion 12 of the frame. The $CO_2$ cartridge 44 is communicated with the compartment 36 via a typical puncture valve 46 at the bottom of the valve body 32.

A plate-like, upright muzzle plug 47 at the front of the gun is secured to the frame 10 by an upright screw 48 which passes upwardly through the front extremity of the barrel area 18 of the frame 10 and is threaded into a rearwardly projecting tang 49 (FIGS. 1 and 5) on the muzzle plug 47. The frame 10 also carries a shroud 50 that partially covers the subassembly unit 20 and is only fragmentarily shown in the drawings. As part of its construction, the shroud 50 includes a forwardmost portion adjacent to the muzzle plug 47 that is in the nature of an underslung, generally U-shaped loop 51 (FIGS. 1–5) secured to the frame 10. As shown in FIG. 5, the shroud 50 also has opposite sidewalls 54 and 56 which extend rearwardly along opposite sides of the gun generally to the breech area where they are joined by an upwardly arched portion 58 that actually covers over and houses the subassembly unit 20 in that area. The exterior, lateral faces of the fore-and-aft sidewalls 54 and 56 may be configured to resemble the slide mechanism of a handgun if desired. The shroud 50 is open along its top extremity in front of the arched portion 58 from the breech area to the muzzle area where an upwardly arched canopy 60 carries an integral front sight 62.

Figure 3:
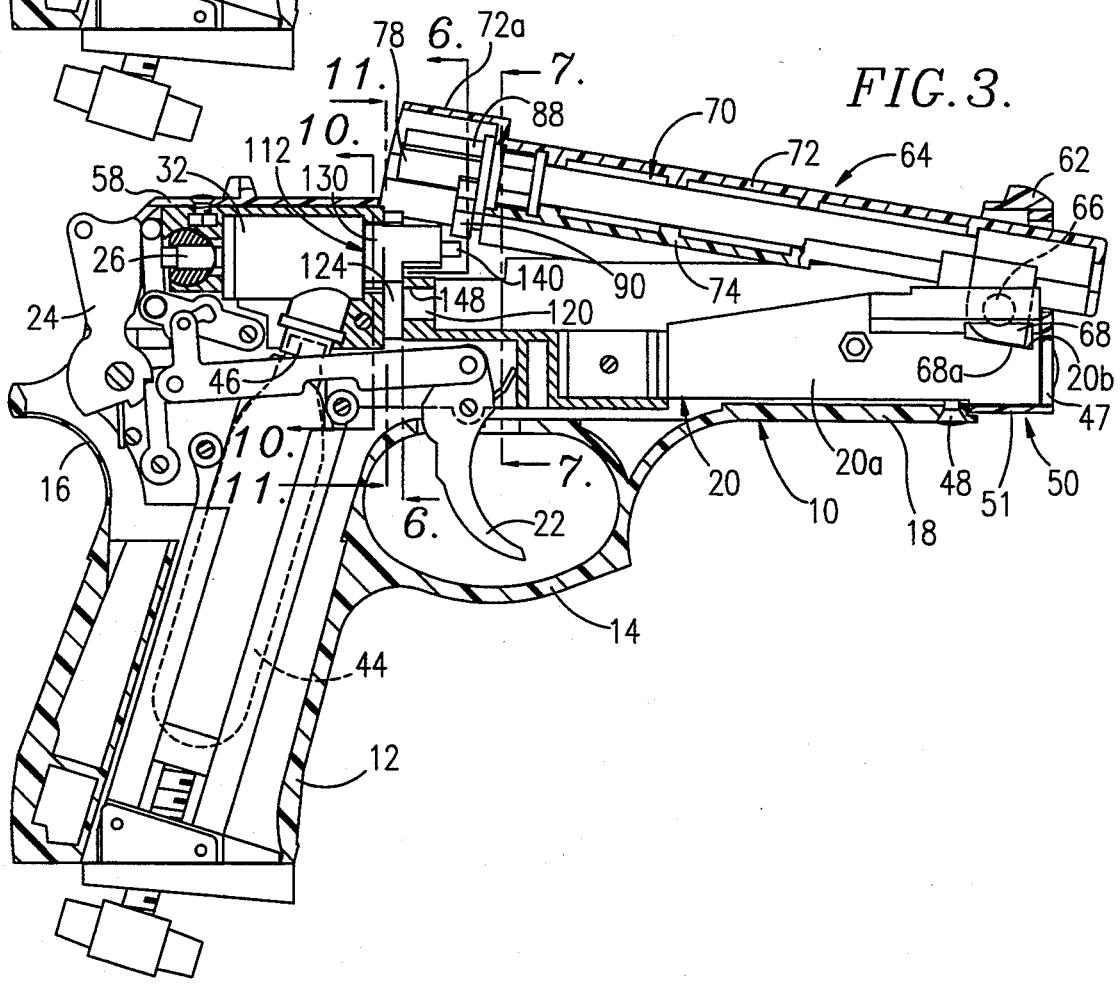
FIG. 3 is a cross sectional view of the gun similar to FIG. 2 but showing the barrel tipped-up into its open position for loading.

A barrel assembly generally designated by the numeral 64 is pivotedly secured to the front end of a fore-and-aft extension bar **20*a* of the subassembly unit 20 by a transverse pivot 66. The barrel assembly 64 is vertically swingable about the transverse pivot 66 between a closed or firing position as illustrated in FIGS. 1 and 2, and an opened or loading position as illustrated in FIG. 3. Depending ears 68 near the front end of the barrel assembly 64 have lowermost limit edges 68*a* that come into engagement with proximal stop edges 20*b* on the subassembly unit extension bar 20*a* to limit the extent of upward swinging of the barrel assembly 64**.

Figure 14:
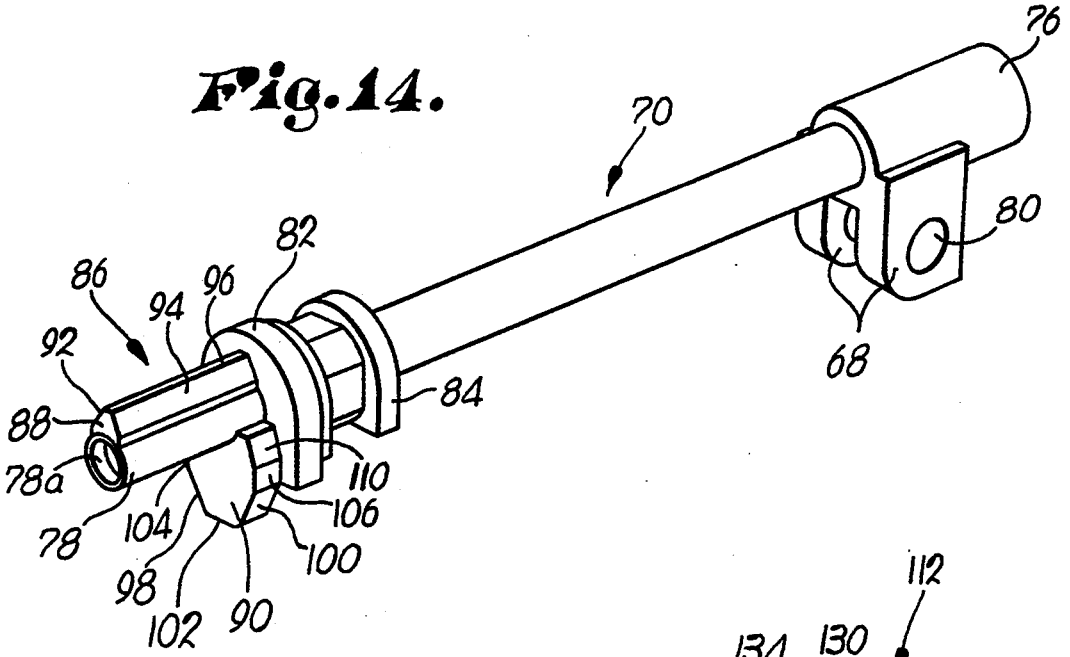
FIG. 14 is a right, rear perspective view of the barrel itself removed from the gun to reveal details of construction.

The barrel assembly 64 includes as its primary component a barrel 70 illustrated in isolation in FIG. 14. The assembly 64 also includes top and bottom barrel shrouds 72 and 74 respectively which envelop the barrel along its length. The top shroud 72 includes a finger grip portion **72*a*** in the breech area of the gun, providing a convenient gripping area for the user when the barrel is grasped and swung between its open and closed positions.

Returning to FIG. 14, it will be seen that the barrel 70 has a muzzle end 76 and a breech end 78. The two mounting ears 68 depend integrally from the muzzle end 76 of the barrel 70 and are provided with aligned transverse holes 80 for the pivot 66. Transverse bulkheads 82 and 84 located inwardly from the breech end 78 help support the upper and lower shrouds 72 and 74.

Also located on the barrel 70 is cam structure broadly denoted by the numeral 86 which cooperates with a detent assembly yet to be described during opening and closing of the barrel assembly 64. The cam structure 86 on the barrel 70 includes two different members, i.e., a top wedge member 88 extending along the top of the barrel 70 between the breech end 78 and the first bulkhead 82, and a bottom wedge member 90 depending from the lower side of the barrel 70 immediately behind the bulkhead 82. The top wedge member 88 is oriented so that its apex points upwardly, thus presenting a pair of opposite, upwardly and inwardly converging, inclined sides 92 and 94. The two sides 92 and 94 share a common, flat ridge 96 at their topmost point of convergence. On the other hand, the bottom wedge member 90 has two sets of wedge-like surfaces, each set converging in a direction which is opposite to that of the other set. In this respect, the bottom wedge member 90 includes a first lower set of inclined wedging sides 98 and 100 which converge downwardly to a common, shared, horizontal base 102. A pair of vertical, non-sloping flats 104 and 106 are located on opposite lateral sides of the wedge member 90 immediately above the lower wedge sides 98 and 100, while a pair of upper, inwardly converging wedge sides 108 and 110 (see also FIGS. 6–13) are located immediately above the flats 104 and 106.

A detent assembly broadly denoted by the numeral 112 is located in the breech area of the gun in position for releasably holding the barrel 64 in its closed or firing position. The detent assembly 112 is designed, however, to release the barrel 64 for tip-up into its loading position of FIG. 3 upon the application of sufficient manual force pulling or pushing upwardly on the barrel assembly 64. As illustrated perhaps best in FIGS. 15 and 16, the detent assembly 112 is generally clam-like in configuration and operation, comprising a pair of cooperating lever arms 114 and 116 that are yieldably biased into clamping engagement with one another. The arms 114 and 116 are swingably interconnected by a fore-and-aft pivot 118, such pivot 118 being fixed to and projecting forwardly from the left lever arm 114 and being journalled within a sleeve 120 on the other lever arm 116. The two lever arms 114,116 have respective legs 122 and 124 that project downwardly beyond the intermediate pivot 118 and capture between themselves a coiled compression spring 126 extending transversely beneath the pivot 118. Suitable locating nibs or the like (not shown) may be provided on the inside facing surfaces of the legs 122 and 124 in order to retain the spring 126 in its proper position, the spring 126 serving to yieldably bias the arms 114 and 116 about the pivot 118 in a manner such that the upper ends of the arms 114,116 are urged toward one another.

Figure 15:
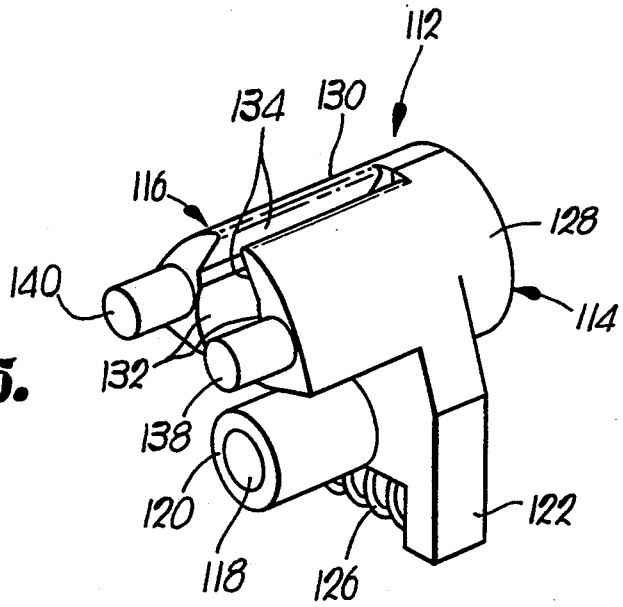
FIG. 15 is a left, front perspective view of the detent assembly.
Figure 16:
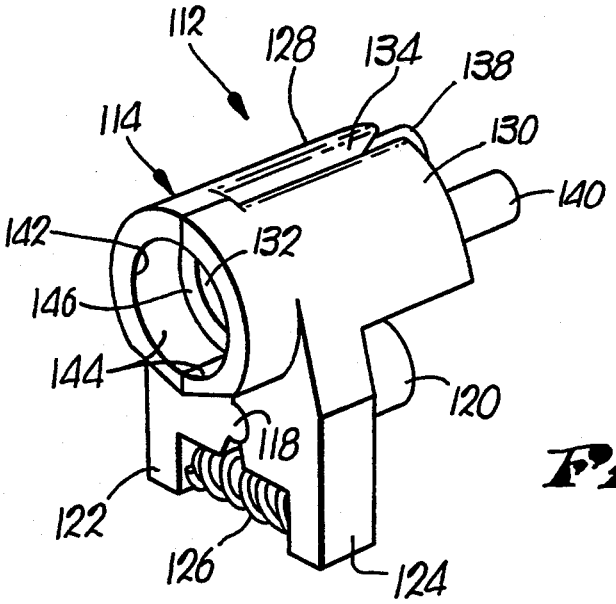
FIG. 16 is a right, rear perspective view of the detent assembly.

The upper ends of the lever arms 114 and 116 are configured to present a pair of clamping jaws 128 and 130, respectively, that securely wrap around and interconnect the breech end 78 of the barrel 70 and the proximal boss 30 of the valve body 32 when the jaws 128,130 are closed, as illustrated in FIGS. 15 and 16. In this respect, each of the jaws 128,130 has an interior arcuate surface 132 that extends fore-and-aft along the length of the jaw and is configured to complementally receive the exterior surface of the barrel 70 when the barrel assembly 64 is in its firing position and the jaws 114 and 116 are in a closed position. The surfaces 132 do not extend completely to the top extremities of each of the jaws 128,130, but instead terminate some distance below the top extremity. This termination permits the jaws to be configured in such a manner as to present a pair of upwardly and inwardly converging flat surfaces 134 that are disposed to come to rest against opposite inclined sides 92 and 94 of the top wedge member 88 on the barrel 70 when the jaws 128,130 are closed and the barrel assembly 64 is in its firing position. A pair of cam projections 138 and 140 project forwardly from respective ones of the jaws 128 and 130 at locations above the pivot 118 for interacting with the bottom wedge member 90 in a manner which will be hereinafter described.

At the rear of the detent assembly 112, the jaws 128 and 130 are configured to present a socket 142 (FIG. 16) when the two jaws 128,130 are engaged together. The socket 142 is configured to complementally receive the projecting outlet boss 30 of the valve body 32 when the detent assembly 112 is closed, as in FIG. 16. The socket 142 presents a pair of arcuate internal surfaces 144 on the jaws 128 and 130 which embrace and engage the arcuate exterior of the outlet boss 30. An annular shoulder 146 is presented by the two jaws 128,130 at the intersection of the arcuate surfaces 144 and the arcuate surfaces 132, the diameter of the socket 142 presented by the arcuate surfaces 144 being slightly larger than the diameter of the cylinder presented by the opposed arcuate surfaces 132. The shoulder 146 is disposed to be directly and intimately opposed to the end of the outlet boss 30 when the detent assembly 112 is closed.

OPERATION

As perhaps shown most clearly in FIGS. 2 and 3, the pivot sleeve 120 of the detent assembly 112 is rotatably received by a bore 148 in the subassembly unit 20 so as to position the detent assembly 112 at the breech area of the gun. The detent assembly 112 thus functions generally to releasably maintain the barrel assembly 64 in its closed position of FIGS. 1 and 2, yet to release the barrel assembly 64 for tip-up into its loading position of FIG. 3 when sufficient force is applied to the barrel assembly 64 in the upward and outward direction. When the barrel assembly 64 is reclosed, the detent assembly 112 provides a reassuring "snap" so as to yield a positive and secure reception of the barrel assembly 64 back down into its closed position, thus reassuring the user that the gun is properly reset for firing.

Figure 7:
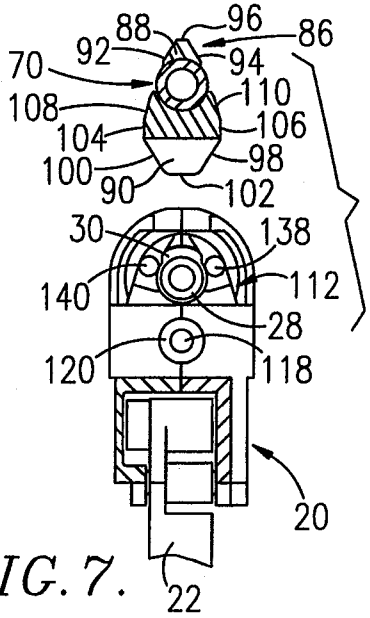
FIG. 7 is a transverse cross sectional view through the gun taken substantially along line 7-7 of FIG. 3, including the tipped-up barrel.
Figure 11:
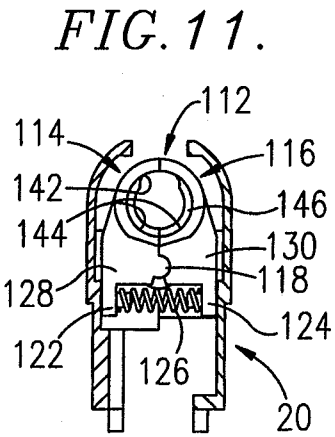
FIG. 11 is a fragmentary transverse cross sectional view of the gun taken substantially along line 11-11 of FIG. 3.
Figure 6:
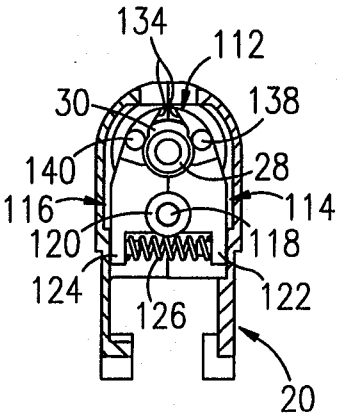
FIG. 6 is a fragmentary, transverse cross sectional view of the breech area of the gun taken substantially along line 6-6 of the FIG. 3 without the barrel.
Figure 10:
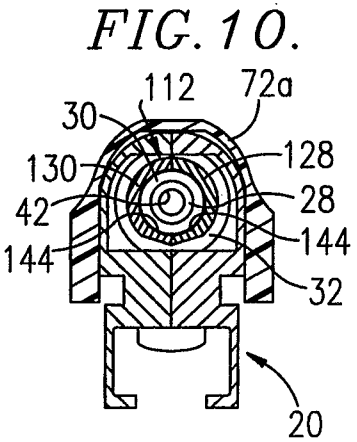
FIG. 10 is a fragmentary transverse cross sectional view of the gun taken substantially along line 10-10 of FIG. 3.

FIGS. 6–13 schematically illustrate the opening and closing action of the barrel assembly 64 and the interaction of the cam structure on the barrel 70 with the cooperating cam structure on the detent assembly 112, i.e, the converging cam surfaces 134 and the cam projections 138,140. FIG. 6 shows the detent assembly in its closed position embracing the outlet boss 30 of the valve body 32, the barrel assembly 64 being raised, as illustrated in FIG. 7. As the barrel assembly 64 is lowered down toward its closed position, the lower wedge sides 98 and 100 of the wedge member 90 come into operating engagement with the cam projections 138 and 140 of the arms 114 and 116, thus spreading the arms 114,116 against the resistance offered by the compression spring 126. This action is illustrated, for example, in FIG. 8.

As the barrel assembly 70 is pushed further down into place, the cam projections 138 and 140 ride up along the flats 104 and 106 on the lower wedge member 90, thus causing no more spreading of the arms 114,116. However, it will be noted that when the arms 114,116 reach this spread condition in which the projections 138,140 are in engagement with the flats of the lower wedge member 90, the upper extremities of the jaws 128 and 130 are sufficiently spaced apart as to clear the breech end 78 of the barrel 70 as it passes down into the detent assembly 112.

Figure 9:
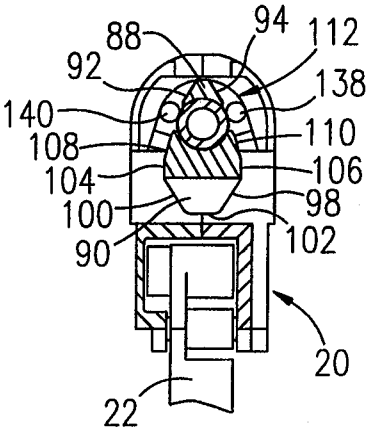
FIG. 9 is a transverse cross sectional view of the gun similar to FIGS. 7 and 8 but with the barrel fully closed in its firing position.
Figure 13:
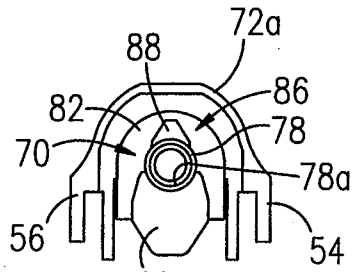
FIG. 13 is a fragmentary end elevational view of the breech end of the barrel.
Figure 8:
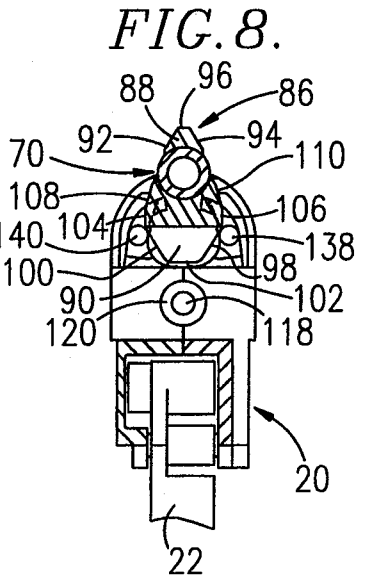
FIG. 8 is a transverse cross sectional view through the gun substantially similar to FIG. 7 but showing the barrel partially lowered into its firing position with the arms of the detent assembly partially spread apart.

As depression of the barrel assembly 64 continues, the cam projections 138,140 slip on up past the flats 104,106 and squeeze against the upwardly inclined wedge sides 108,110 in a sliding action. By this time, the detent assembly 112 has in effect gone "over center" by virtue of the cam projections 138,140 passing upwardly beyond the flats 104,106; consequently, the barrel assembly 64 quickly snaps on down into its firing position in which location the cam projections 138,140 are spaced above the lower cam wedge 90 and along side extremities of the breech end 78 of the barrel 70, as illustrated in FIG. 9. Here, the opposite inclined flat surfaces 134 on the jaws 128,130 bear against the cam sides 92 and 94 of the upper wedge member 88, all of which serves to releasably hold the barrel assembly in its closed or firing position.

Figure 12:
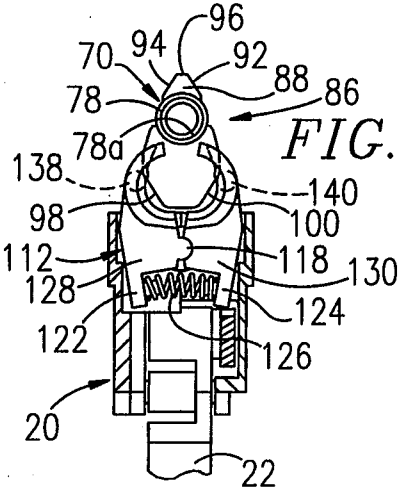
FIG. 12 is a fragmentary transverse cross sectional view of the gun substantially identical to FIG. 11 but illustrating the barrel as it is being lowered into the firing position and is spreading the arms of the detent assembly apart.

In order to open the barrel assembly 64, upward lifting force is applied thereto so as to snappingly disengage the cam structures 86 on the barrel 70 from those on the detent assembly 112. Upon initial upward movement of the barrel assembly 64, the inclined sides 92,94 of the upper wedge member 88 slide against the mating inclined surfaces 134 on the detent jaws 128,130, thus forcing the jaws apart. As upward movement of the barrel assembly 64 continues, the cam projections 138,140 come into operating engagement with the upper wedge sides 108,110, which serve to further spread the jaws 128,130 apart. By the time the flats 104,106 come into engagement with the cam projections 138,140, the jaws 128,130 have been sufficiently spaced apart as to clear the breech end 78 of the barrel 70. From that point on the cam projections 138,140 slip along the downwardly converging sides 98 and 100 of the lower wedge member 90, as illustrated in FIG. 12, permitting the arms of the detent assembly 112 to swing back toward one another. When fully closed again, the socketed end of the detent assembly 112 embraces the boss 30 of the valve body 32, while the interior of the jaws 128,130 forwardly thereof remains empty due to the absence of the breech end 78 of the raised barrel 70.

It is to be appreciated that when the barrel assembly 64 is in its closed position, the detent assembly 112 securely and rigidly interconnects the valve body 32 and the barrel 70. This secure interconnection and stabilizing action occurs closely adjacent the point of gas transfer between the end of the outlet boss 30 and the breech end 78 of the barrel 70. Since the jaws 128,130 overlap the boss 30 and the breech end 78 at that location and are spring biased into contacting engagement with those parts, there is a secure stabilizing action that occurs at the critical point of gas transfer. Consequently, not only is the barrel assembly 64 locked down securely, but the various sealing surfaces of the jaws 128 and 130 function to assist in minimizing the escape of gas during the firing action. Furthermore, the barrel 70 is accurately and precisely brought into exact alignment with the valve body boss 30 each time the gun is prepared for firing, thus increasing accuracy and repeatability.

It is also to be noted that when the gun is fired, causing the valve stem to be unseated from the valve seat 38, the valve stem 28 is so perfectly aligned with the breech end 78 of the barrel 70 that the stem 28 is permitted to slide forwardly into a slightly enlarged area **78*a* of the barrel 70 (see FIG. 1). This movement of the valve stem 28 into the breech end 78 of the barrel 70 helps minimize gas escape during the firing action and also serves to increase the projectile speed. Although FIG. 1 shows the discharge end of the valve stem 28 set back a short distance from the corresponding discharge end of the valve body boss 30 when the valve is in its closed position, in the preferred form of the invention the discharge end of the stem 28 would be positioned as close as possible to the proximal end of the boss 30 so as to encourage early entry of the stem 28 into the enlarged area 78*a* of the barrel 70** when the gun is fired.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

I claim:

1. In a gas-powered gun having a barrel which is swingable between a closed position in which the barrel is axially aligned with an outlet projection of a gas compartment in the gun and an open position in which the barrel is displaced out of alignment with the projection to facilitate loading of a projectile into the breech end of the barrel, improved means for releasably holding the barrel in said closed position comprising:

a detent assembly shiftable between retaining and releasing positions, said detent assembly being operable to secure the breech end of the barrel to the outlet projection when the barrel is in its closed position and the detent assembly is in its retaining position whereby to immobilize the barrel relative to the outlet projection for firing, and being operable to allow movement of the barrel into and out of its closed position when the detent assembly is in its releasing position, said assembly including means for yieldably biasing the assembly toward said retaining position; and interengagable cam structure on the barrel and the detent assembly disposed to cause the detent assembly to shift to its releasing position and release the barrel when the barrel is manually forced toward its open position with sufficient force to overcome said yieldable biasing means.

2. In a gas-powered gun having a barrel which is swingable between a closed position in which the barrel is axially aligned with an outlet projection of a gas compartment in the gun and an open position in which the barrel is displaced out of alignment with the projection to facilitate loading of a projectile into the breech end of the barrel, improved means for releasably holding the barrel in said closed position comprising:

a detent assembly shiftable between retaining and releasing. positions, said detent assembly being operable to secure the breech end of the barrel to the outlet projection when the barrel is in its closed position and the detent assembly is in its retaining position whereby to immobilize the barrel relative to the outlet projection for firing, and being operable to allow movement of the barrel into and out of its closed position when the detent assembly is in its releasing position, said assembly including means for yieldably biasing the assembly toward said retaining position; and interengagable cam structure on the barrel and the detent assembly for yieldably shifting the assembly to its releasing position upon the application of at least a certain predetermined amount of force in a certain direction by the cam structure of the barrel against the cam structure of the detent assembly whereby to permit the barrel to be manually opened and closed by forcibly overcoming the spring means, said detent assembly including a pair of opposed retaining jaws shiftable toward and away from one another by the action of said yieldable biasing means and the interaction of said cam structures as the barrel is opened and closed.

3. In a gas-powered gun as claimed in claim 2, said jaws being provided with sealing surfaces disposed to engage the barrel and the outlet projection in a manner to minimize gas escape during firing of the gun.

4. In a gas-powered gun as claimed in claim 3, said sealing surfaces including on each jaw a rearwardly disposed, arcuate inner face configured complementally to a proximal outer sidewall of the outlet projection so that the sidewall is intimately embraced by the inner faces of the jaws when the latch is in its retaining position, said sealing surfaces further including on each jaw a forwardly disposed, arcuate inner contour configured complementally to a proximal outer sidewall of the barrel so that the sidewall of the barrel is intimately embraced by the inner contours of the jaws when the latch is in its retaining position and the barrel is in its closed position.

5. In a gas-powered gun as claimed in claim 4, said sealing surfaces additionally including a recessed, rearwardly facing, arcuate shoulder on each of said jaws respectively located between the sealing face and the sealing contour thereof in position for opposing an annular end extremity of the outlet projection when the detent assembly is in its retaining position.

6. In a gas-powered gun as claimed in claim 4, said jaws being pivotally supported for swinging movement between said retaining and releasing positions thereof.

7. In a gas-powered gun as claimed in claim 6, said jaws each comprising part of a swingable, upright lever arm having a pair of opposite, upper and lower ends, the axis of swinging movement of each lever arm being located intermediate said upper and lower ends and extending in a fore-and-aft direction, said jaws being located at the upper ends of the lever arms and said yieldable biasing means being operably connected between said lower ends of the lever arms whereby to bias the jaws toward one another about said axes.

8. In a gas-powered gun as claimed in claim 7, said cam structure on the detent assembly including cam surfaces on both of said lever arms generally adjacent the upper ends thereof in position for operating engagement with the cam structure on the barrel as the barrel is opened and closed whereby to spread the jaws apart.

9. In a gas-powered gun as claimed in claim 8, said cam surfaces on the lever arms including a pair of upwardly and inwardly converging cam surfaces overlying the barrel when the barrel is closed and used to spread the jaws apart an initial distance as the barrel is opened, said cam structure on the barrel including an upper wedge member on a top surface of the barrel in position to be embraced by said converging cam surfaces of the lever arms, said wedge member having a pair of upwardly and inwardly converging spreader surfaces engaged by respective ones of the converging cam surfaces on the lever arms when the barrel is closed for spreading the upper ends of the levers apart as the barrel is opened.

10. In a gas-powered gun as claimed in claim 9, said cam surfaces on the lever arms further including a pair of projections below the converging sur faces on opposite ones of the levers for spreading the jaws apart a final distance as the barrel is opened, said cam surfaces on the barrel further including a lower wedge member projecting downwardly from the barrel in position to be embracingly engaged by said projections following interengagement of the spreader surfaces and the converging surfaces during opening of the barrel, said lower wedge member having a pair of upwardly and inwardly converging spreader surfaces engageable with corresponding ones of the projections.

11. In a gas-powered gun as claimed in claim 10, said lower wedge member having a pair of downwardly and inwardly converging spreader surfaces below said upwardly and inwardly converging spreader surfaces in disposition for engagement with said projections on the lever arms when the barrel is shifted toward its closed position from its open position for spreading the jaws of the arms apart to clear the barrel.

12. In a gas-powered gun a claimed in claim 11, said lower wedge member having a pair of opposite, parallel flat surfaces located between said upper spreading surfaces and said lower spreading surfaces of the lower wedge member in disposition for engagement with said projections for maintaining the jaws of the lever arms at a constant distance apart as the barrel passes between the jaws during movement between its opened and closed positions.

13. In a gas-powered gun having a barrel which is swingable between a closed position in which the barrel is axially aligned with an outlet projection of a gas compartment in the gun and an open position in which the barrel is displaced out of alignment with the projection to facilitate loading of a projectile into the breech end of the barrel, improved means for releasably holding the barrel in said closed position comprising:

a detent assembly shiftable between retaining and releasing positions, said detent assembly being operable to secure the breech end of the barrel to the outlet projection when the barrel is in its closed position and the detent assembly is in its retaining position whereby to immobilize the barrel relative to the outlet projection for firing, and being operable to allow movement of the barrel into and out of its closed position when the detent assembly is in its releasing position, said assembly including means for yieldably biasing the assembly toward said retaining position; and interengagable cam structure on the barrel and the detent assembly for yieldably shifting the assembly to its releasing position upon the application of at least a certain predetermined amount of force in a certain direction by the cam structure of the barrel against the cam structure of the detent assembly whereby to permit the barrel to be manually opened and closed by forcibly overcoming the spring means, said detent assembly including a pair of opposed retaining jaws shiftable toward and away from one another by the action of said yieldable biasing means and the interaction of said cam structures as the barrel is opened and closed, said jaws being pivotally supported for swinging movement between said retaining and releasing positions thereof.

14. In a gas-powered gun as claimed in claim 13, said jaws each comprising part of a swingable, upright lever arm having a pair of opposite, upper and lower ends, the axis of swinging movement of each lever arm being located intermediate said upper and lower ends and extending in a fore-and-aft direction, said jaws being located at the upper ends of the lever arms and said yieldable biasing means being operably connected between said lower ends of the lever arms whereby to bias the jaws toward one another about said axes

15. In a gas-powered gun as claimed in claim 14, said cam structure on the detent assembly including cam surfaces on both of said lever arms generally adjacent the upper ends thereof in position for operating engagement with the cam structure on the barrel as the barrel is opened and closed whereby to spread the jaws apart.

16. In a gas-powered gun as claimed in claim 15, said cam surfaces on the lever arms including a pair of upwardly and inwardly converging cam surfaces overlying the barrel when the barrel is closed and used to spread the jaws apart an initial distance as the barrel is opened, said cam structure on the barrel including an upper wedge member on a top surface of the barrel in position to be embraced by said converging cam surfaces of the lever arms, said wedge member having a pair of upwardly and inwardly converging spreader surfaces engaged by respective ones of the converging cam surfaces on the lever arms when the barrel is closed for spreading the upper ends of the levers apart as the barrel is opened.

17. In a gas-powered gun as claimed in claim 16, said cam surfaces on the lever arms further including a pair of projections below the converging surfaces on opposite ones of the levers for spreading the jaws apart a final distance as the barrel is opened, said cam surfaces on the barrel further including a lower wedge member projecting downwardly from the barrel in position to be embracingly engaged by said projections following interengagement of the spreader surfaces and the converging surfaces during opening of the barrel, said lower wedge member having a pair of upwardly and inwardly converging spreader surfaces engageable with corresponding ones of the projections.

18. In a gas-powered gun as claimed in claim 17, said lower wedge member having a pair of downwardly and inwardly converging spreader surfaces below said upwardly and inwardly converging spreader surfaces in disposition for engagement with said projections on the lever arms when the barrel is shifted toward its closed position from its open position for spreading the jaws of the arms apart to clear the barrel.

19. In a gas-powered gun as claimed in claim 13, said cam structure on the detent assembly including cam surfaces on both of said jaws generally adjacent the upper ends thereof in position for operating engagement with the cam structure on the barrel as the barrel is opened and closed whereby to spread the jaws apart.

20. In a gas-powered gun as claimed in claim 19, said cam surfaces on the jaws including a pair of upwardly and inwardly converging cam surfaces overlying the barrel when the barrel is closed and used to spread the jaws apart an initial distance as the barrel is opened, said cam structure on the barrel including an upper wedge member on a top surface of the barrel in position to be embraced by said converging cam surfaces of the jaws, said wedge member having a pair of upwardly and inwardly converging spreader surfaces engaged by respective ones of the converging cam surfaces on the jaws when the barrel is closed for spreading the upper ends of the jaws apart as the barrel is opened.

21. In a gas-powered gun as claimed in claim 20, said cam surfaces on the jaws further including a pair of projections below the converging surfaces on opposite ones of the jaws for spreading the jaws apart a final distance as the barrel is opened, said cam surfaces on the barrel further including a lower wedge member projecting downwardly from the barrel in position to be embracingly engaged by said projections following interengagement of the spreader surfaces and the converging surfaces during opening of the barrel, said lower wedge member having a pair of upwardly and inwardly converging spreader surfaces engageable with corresponding ones of the projections.

22. In a gas-powered gun as claimed in claim 21, said lower wedge member having a pair of downwardly and inwardly converging spreader surfaces below said upwardly and inwardly converging spreader surfaces in disposition for engagement with said projections on the jaws when the barrel is shifted toward its closed position from its open position for spreading the jaws of the arms apart to clear the barrel.

23. In a gas-powered gun a claimed in claim 22, said lower wedge member having a pair of opposite, parallel flat surfaces located between said upper spreading surfaces and said lower spreading surfaces of the lower wedge member in disposition for engagement with said projections for maintaining the jaws at a constant distance apart as the barrel passes between the jaws during movement between its opened and closed positions.

* * * * *